United States Patent [19]

Iwakura et al.

[11] 4,446,209

[45] May 1, 1984

[54] HEAT-SENSITIVE RECORDING MATERIALS

[75] Inventors: Ken Iwakura, Kanagawa; Takekatsu Sugiyama, Shizuoka, both of Japan

[73] Assignee: Fuji Photo Film Co., Ltd., Kanagawa, Japan

[21] Appl. No.: 440,659

[22] Filed: Nov. 10, 1982

[30] Foreign Application Priority Data

Nov. 11, 1981 [JP] Japan ..... 56-180634

[51] Int. Cl.[3] ..... B41M 5/18

[52] U.S. Cl. ..... 346/216

[58] Field of Search ..... 282/27.5; 428/320.8, 428/411, 488, 537, 913, 914; 427/150–153

[56] References Cited

FOREIGN PATENT DOCUMENTS 6127486 10/1981 Japan ..... 346/216

*Primary Examiner*—Bruce H. Hess

*Attorney, Agent, or Firm*—Sughrue, Mion, Zinn, Macpeak, and Seas

[57] ABSTRACT

A heat-sensitive recording material is disclosed. The material is comprised of an electron donating colorless dye an electron accepting compound. The electron accepting compound is represented by general formula (I)

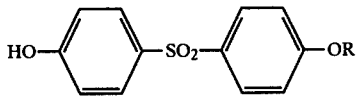

(I)

wherein R is an alkyl group, an aralkyl group, an aryl group, an alkylcarbonyl group, an arylcarbonyl group, an alkylsulfonyl group or an arylsulfonyl group. The resulting heat-sensitive recording material is capable of producing an image with improved color density while avoiding an increase in undesirable fog density.

4 Claims, No Drawings

HEAT-SENSITIVE RECORDING MATERIALS

FIELD OF THE INVENTION

The present invention relates to heat-sensitive recording materials and particularly to heat-sensitive recording materials having improved color developing properties.

BACKGROUND OF THE INVENTION

Heat-sensitive recording materials comprising an electron donating colorless dye (color former) and an electron accepting compound (color developer) have been disclosed in Japanese Patent Publications 14039/70 (corresponding to U.S. Pat. No. 3,539,375) and 4160/68 (corresponding to U.S. patent application Ser. No. 512,546). Such heat-sensitive recording materials must have at least the following characteristics: (1) the color density and the color sensitivity must be sufficiently high, (2) fogging (coloration during preservation before using) is not caused and (3) the colors developed have sufficient fastness. However, present recording materials do not completely satisfy these requirements.

Recently, studies concerning the above described requirement (1) have been carried out due to recently developed high speed heat-sensitive recording systems.

Examples of the electron accepting compound in the heat-sensitive recording materials include phenol compounds, organic acids and salts thereof, and oxybenzoic acid esters, etc. Particularly, phenol compounds are preferably used, because they have a melting point near the desired recording temperature. They have been described in detail in, for example, Japanese Patent Publication Nos. 14039/70 and 29830/76, and U.S. Pat. Nos. 3,244,549 and 3,244,550.

In order to meet requirement (i), one approach has been to elevate the melting point of the electron accepting compound from 60° C. to 100° C. However, in phenolic compounds which have been widely used at present as the electron accepting compounds, it is difficult to control the melting point. Further, the phenolic compounds have little practical value, because they are expensive.

Other approaches have been described in Japanese Patent Publication Nos. 17748/74 and 39567/76. These approaches involve the use of a combination of an organic acid and a phenolic compound as an electron accepting material or the use of polyvalent metal salts of compounds having an alcoholic hydroxy group. Further, it has been described in Japanese Patent Publication No. 29945/76 to use hydroxyethyl cellulose and a copolymer of maleic acid anhydride salt.

Further, the addition of waxes has been described in Japanese Patent Publication No. 27599/76 and Japanese Patent Application (OPI) No. 19231/73 (The term "OPI" as used herein refers to a "published unexamined Japanese Patent Application").

Additional approaches have been described in Japanese Patent Application (OPI) Nos. 34842/74, 115554/74, 149353/75, 106746/77, 5636/78, 11036/78, 48751/78 and 72996/81. These approaches involve adding nitrogen containing organic compounds such as thioacetanilide, phthalonitrile, acetamide, di-β-naphthyl-p-phenylenediamine, aliphatic acid amide, acetoacetanilide, diphenylamine, benzamide oricarbazole, etc., thermoplastic substances such as 2,3-m-tolylbutane or 4,4'-dimethylbiphenyl, etc. or carboxylic acid esters such as dimethyl isophthalate, diphenyl phthalate or dimethyl terephthalate, etc. as a sensitizer.

However, the heat-sensitive recording materials produced by the above described techniques are insufficient with respect to color density and the color sensitivity.

SUMMARY OF THE INVENTION

Accordingly, an object of the present invention is to provide heat-sensitive recording materials which have a sufficient color density and sensitivity.

The objects of the present invention have been attained by producing heat-sensitive recording materials comprising an electron donating colorless dye and an electron accepting compound represented by the following general formula (I):

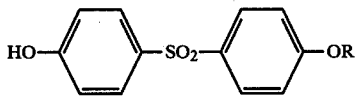

(I)

wherein R represents an alkyl group, an aralkyl group, an aryl group, an alkylcarbonyl group, an arylcarbonyl group, an alkylsulfonyl group or an arylsulfonyl group.

DETAILED DESCRIPTION OF THE INVENTION

In the above described general formula (I), the substituent represented by R may have substituents. Examples of the substituents include alkyl groups, alkoxy groups, aryloxy groups and halogen atoms.

The phenol compounds according to the present invention have the following characteristics.

(1) Color images formed with the compounds have high density. The high density images are obtained by combining the compounds with an electron donating colorless compound. Although a high density image is obtained, the degree of fogging before development is very low.

(2) The color images formed with materials of the invention are stable hardly fade by the passage of time, even when exposed to humidity and light, etc.

(3) They hardly cause sublimation and are stabilized.

(4) They are easily synthesized, by which a high quality and percentage yield can be obtained. Further, raw materials used in the synthesis are inexpensive.

It is preferable to use an electron accepting compound wherein R in the above described general formula (I) represents an alkyl group, a halogen substituted alkyl group, an alkoxy substituted alkyl group, an aralkyl group, an alkyl substituted aralkyl group, an alkoxy substituted aralkyl group, an alkylcarbonyl group or an arylcarbonyl group.

In the above described substituents, alkyl groups, aralkyl groups and alkyl substituted aralkyl groups are particularly preferred. Examples of these particularly preferred substituent groups include alkyl groups having 6 to 20 carbon atoms, aralkyl groups having 7 to 20 carbon atoms and alkyl substituted aralkyl groups having 8 to 25 carbon atoms.

Examples of the electron accepting compounds according to the present invention are described in the following. However, the present invention is not limited to them.

(1) 4-Hydroxyphenyl-4'-n-butyloxyphenyl sulfone.

(2) 4-Hydroxyphenyl-4'-n-hexyloxyphenyl sulfone.
(3) 4-Hydroxyphenyl-4'-n-octyloxyphenyl sulfone,
(4) 4-Hydroxyphenyl-4'-n-decyloxyphenyl sulfone.
(5) 4-Hydroxyphenyl-4'-n-dodecyloxyphenyl sulfone.
(6) 4-Hydroxyphenyl-4'-benzyloxyphenyl sulfone.
(7) 4-Hydroxyphenyl-4'-p-isopropylbenzyloxyphenyl sulfone.
(8) 4-Hydroxyphenyl-4'-β-phenetyloxyphenyl sulfone.
(9) 4-Hydroxyphenyl-4'-β-ethoxyethyloxyphenyl sulfone.
(10) 4-Hydroxyphenyl-4'-β-butoxyethyloxyphenyl sulfone.
(11) 4-Hydroxyphenyl-4'-β-phenoxyethyloxyphenyl sulfone.
(12) 4-Hydroxyphenyl-4'-o-chlorobenzoyloxyphenyl sulfone.
(13) 4-Hydroxyphenyl-4'-β-t-butylbenzoyloxyphenyl sulfone.
(14) 4-Hydroxyphenyl-4'-β-t-octylbenzoyloxyphenyl sulfone.
(15) 4-Hydroxyphenyl-4'-lauroyloxyphenyl sulfone.
(16) 4-Hydroxyphenyl-4'-decanoyloxyphenyl sulfone.
(17) 4-Hydroxyphenyl-4'-myristoyloxyphenyl sulfone.
(18) 4-Hydroxphenyl-4'-stearyloxyphenyl sulfone.
(19) 4-Hydroxyphenyl-4'-β-phenoxypropionyloxyphenyl sulfone.
(20) 4-Hydroxyphenyl-4'-hexadecylsulfonyloxyphenyl sulfone.
(21) 4-Hydroxyphenyl-4'-decylsulfonyloxyphenyl sulfone.
(22) 4-Hydroxyphenyl-4'-p-toluenesulfonyloxyphenyl sulfone.
(23) 4-Hydroxyphenyl-4'-p-isopropylbenzenesulfonyloxyphenyl sulfone.
(24) 4-Hydroxyphenyl-4'-(4-p-t-butylphenoxybutyloxy)phenyl sulfone.
(25) 4-Hydroxyphenyl-4'-(4-p-t-amylphenoxybutyloxy)phenyl sulfone.
(26) 4-Hydroxyphenyl-4'-(5-p-t-butylphenoxyamyloxy)phenyl sulfone.
(27) 4-Hydroxyphenyl-4'-(6-p-t-butylphenoxyhexyloxy)phenyl sulfone.

Examples of electron donating colorless dyes used in the present invention include triarylmethane compounds, diphenylmethane compounds, xanthene compounds, thiazine compounds and spiropyran compounds. Triarylmethane compounds and xanthene compounds are more preferred.

Examples of triarylmethane compounds include 3,3-bis-(p-dimethylaminophenyl)-6-dimethylaminophthalide (i.d. Crystal Violet lactone), 3,3-bis-(p-dimethylaminophenyl)phthalide, 3-(p-dimethylaminophenyl)-3-(1,3-dimethylindol-3-yl)phthalide and 3-(p-dimethylaminophenyl)-3-(2-methylindol-3-yl)phthalide.

Examples of diphenylmethane compounds include 4,4'-bis-dimethylaminobenzohydrin benzyl ether, N-halophenylleuco Auramine and N-2,4,5-trichlorophenyl leuco Auramine.

Examples of xanthene compounds include Rhodamine B anilinolactam, Rhodamine (p-nitroanilino)lactam, Rhodamine B (p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trichloromethylanilino-6,6-diethylaminofluoran, 2-butylamino-3-chloro-6-diethylaminofluoran, 2-ethoxyethylamino-3-chloro-6-diethylaminofuluoran, 2-anilino-3-chloro-6-diethylaminofluoran, 2-diphenylamino-6-diethylaminofluoran, 2-anilino-3-methyl-6-diphenylaminofluoran and 2-phenyl-6-diethylaminofluorane.

Examples of thiazine compounds include benzoyl leuco Methylene Blue and p-nitrobenzyl leuco Methylene Blue. Examples of spiro compounds include 3-methyl-spiro-dinaphthopyran, 3-ethyl-spiro-dinaphthopyran, 3,3'-dichloro-spiro-dinaphthopyran, 3-benzyl spiro-dinaphthopyran, 3-methyl-naphtho-(3-methoxybenzo)spiropyran and 3-propyl-spiro-dibenzopyran.

Any of the above referred to compounds may be used alone or in combination with one another.

A process for synthesizing the electron accepting compounds of the present invention is described below.

The compounds represented by general formula (I) can be obtained easily by reacting bisphenol S (bis-4-hydroxyphenyl sulfone) with corresponding alkyl halide, alkyl methanesulfonate, alkyl toluene sulfonate, aralkyl halide, aryl halide, alkylcarbonyl halide, arylcarbonyl halide, alkylsulfonyl halide or arylsulfonyl halide in equimolar amounts.

Examples of synthesizing the electron accepting compounds according to the present invention are described below.

SYNTHESIS EXAMPLE 1

Synthesis of 4-hydroxyphenyl-4'-benzyloxyphenyl sulfone (Compound (6))

30.0 g of bisphenol S, 12.7 g of benzyl chloride, 100 ml of dimethylformamide and 14 g of potassium carbonate were put in a flask, and the mixture was stirred at 100° C. for 2 hours. After cooling, the reaction mixture was poured into water, and precipitated crystals were filtered off. The resulting crystals were purified with a silica gel column to obtain 24.7 g of 4-hydroxyphenyl-4'-benzyloxyphenyl sulfone (melting point: 163° C.).

SYNTHESIS EXAMPLE 2

Synthesis of 4-hydroxyphenyl-4'-octyloxyphenylsulfone (Compound (3))

25 g of bisphenol S, 19.3 g of octyl bromide, 100 ml of dimethylformamide and 14 g of potassium carbonate were put in a flask, and the mixture was stirred at 100° C. for 4 hours. After cooling, the same procedure as in Synthesis Example 1 was carried out to obtain 18.5 g of 4-hydroxyphenyl-4'-octyloxyphenyl sulfone (melting point: 61° C.).

SYNTHESIS EXAMPLE 3

Synthesis of 4-hydroxyphenyl-4'-(4-p-t-butylphenoxybutyloxy)phenyl sulfone (Compound (24))

25 g of bisphenol S, 28.5 g of p-t-butylphenoxybutyl bromide, 100 ml of dimethylformamide and 14 g of potassium carbonate were put in a flask, and the mixture was stirred at 100° C. for 4 hours. After cooling, the same procedure as in Synthesis Example 1 was carried out to obtain 19.3 g of 4-hydroxyphenyl-4'-(4-p-t-butylphenoxybutyloxy)phenyl sulfone (melting point: 147° C.).

Embodiments of the process for producing heat-sensitive recording materials according to the present invention are illustrated below.

The most general process for producing the heat-sensitive recording materials will be described first. The above described electron donating colorless dye and the electron accepting compound were dispersed, respectively, in a 1 to 10 wt.%, preferably 2 to 8 wt.%, aqueous solution of high polymer by means such as a ball mill or a sand mill.

Preferred examples of high polymer include a polyvinyl alcohol (PVA), a methylcellulose, a hydroxyethylcellulose, an acryl amide series copolymer and a latex. Of the above high polymers, the polyvinyl alcohol is most preferably used. The molecular weight of the polyvinyl alcohol ranges from 1,000 to 20,000, preferably 1,500 to 10,000. After the blending was completed inorganic pigments such as kaolin, talc or calcium carbonate were added to produce a coating solution. If necessary, paraffin wax emulsions, latex binders, sensitizers, metal soaps and ultraviolet ray absorbers may be added to the coating solution.

Generally the coating solution is applied to a paper base.

The coating amount is generally 2 to 10 g/m$^2$, preferably 4 to 8 g/m$^2$, as a solid content. The lower limit depends upon the color density when heated, and the upper limit depends chiefly upon economic restriction.

The electron donating colorless dye used in the present invention is 0.1 to 2.0 g/m$^2$, preferably 0.2 to 1.0 g/m$^2$. The electron accepting compound is used in an amount of 0.1 to 4.0 g/m$^2$, preferably 0.5 to 2.0 g/m$^2$.

The following is a detailed description of a specific example which was prepared. However, the present invention is not limited to this example.

EXAMPLE (1) Production of Samples 1–3

5 g of the electron donating colorless dye shown in Table 1 was dispersed in 50 g of a 5% aqueous solution of polyvinyl alcohol (saponification value: 99%, degree of polymerization: 1000) by means of a ball mill for about 24 hrs. On the other hand, 20 g of the electron accepting compound (phenols) shown in Table 1 was dispersed similarly in 200 g of a 5% aqueous solution of polyvinyl alcohol by means of a ball mill for about 24 hrs. After the two dispersed solutions were blended, 20 g of kaolin (Georgia Kaolin) was added and dispersed therein. In addition, 5 g of a 50% paraffin wax emulsion (Chukyo Yushi Cellosol #428) was added to produce a coating solution.

The coating solution was applied to a paper base having an areal weight of 50 g/m$^2$ so as to result in a solid coating amount of 6 g/m$^2$. After the coating was dried at 60° C. for 1 minute, it was treated with a supercalender at a linear pressure of 60 kgW/cm to obtain a coated paper.

(2) Production of Samples 4–6

5 g of the electron donating colorless dye shown in Table 1 was dispersed in 50 g of a 5% aqueous solution of polyvinyl alcohol (saponification value: 99%; degree of polymerization: 1000) by means of a ball mill for about 24 hrs. On the other hand, 20 g of the electron accepting compound (phenols) shown in Table 1 was dispersed similarly in 200 g of a 5% aqueous solution of polyvinyl alcohol by means of a ball mill for about 24 hrs. Further, 20 g of an additive shown in Table 1 was dispersed in a 5% aqueous solution of polyvinyl alcohol by means of a ball mill for about 24 hrs. After these three dispersions were blended, 20 g of kaolin (Georgia Kaolin was added and dispersed therein. In addition, 5 g of a 50% paraffin wax emulsion (Chukyo Yushi Cellosol #428) was added thereto to prepare a coating solution.

The coating solution was applied to a paper base having an areal weight of 50 g/m$^2$ so as to result in a solid coating amount of 6 g/m$^2$. After the coating was dried at 60° C. for 1 minute, it was treated with a supercalender at a linear pressure of 60 kg W/cm to obtain a coated paper.

The coated paper was thermally developed at a heat energy of 4 mJ/mm$^2$ by means of a facsimile receiving set (Type EF-22, made by Matsushita Denso Co., Ltd.), and the color density was determined.

The developed image was preserved at 45° C. and RH 80% for a week. Thereafter, evaluation of fastness was carried out by determining an increase in fog of the undeveloped part and the residual ratio of the image on the developed part ((density after treatment/density before treatment)×100). Further, fastness to light was evaluated by placing the developed image under a light of 32,000 luxes for 10 hours. The results are shown in Table 1.

(3) Production of Comparative Samples 1–3

The same examination was carried out using the same composition as in Samples 1–6, except that the compound shown in Table 1 was used instead of the electron accepting compound of the present invention. The results are shown in Table 1.

When the fog density in Table 1 exceeds 0.13, the commercial value deteriorates remarkably. Further, it is preferred that the residual ratio of the developed matter be 90% or more.

It is understood from this point of view that the electron accepting compounds of the present invention produce remakably excellent heat-sensitive recording sheets.

It clearly appears as though the use of compounds covered by general formula (I) make it possible to produce a heat-sensitive recording material which achieve the objects of the present invention.

TABLE 1

| Sample No. | Electron donating colorless dye | Electron accepting compound | Additive | Preservation stability: Fog density | Color density | Fog density | Residual ratio | Fastness to light Residual ratio |
|---|---|---|---|---|---|---|---|---|
| 1 (this invention) | 2-Anilino-3-methyl-6-diethylamino-fluoran | 4-Hydroxyphenyl-4'-octyloxyphenyl sulfone | — | 0.06 | 1.07 | 0.10 | 99% | 100% |
| 2 (this invention) | 2-Anilino-3-chloro-6-diethylamino-fluoran | 4-Hydroxyphenyl-4'-octyloxyphenyl sulfone | — | 0.06 | 1.07 | 0.09 | 95% | 100% |
| 3 (this invention) | 2-Anilino-3-chloro-6-diethylamino-fluoran | 4-Hydroxyphenyl-4'-dodecyloxyphenyl sulfone | — | 0.07 | 1.06 | 0.08 | 95% | 98% |

TABLE 1-continued

| Sample No. | Electron donating colorless dye | Electron accepting compound | Additive | Preservation stability: Fog density | Color density | Fog density | Residual ratio | Fastness to light Residual ratio |
|---|---|---|---|---|---|---|---|---|
| 4 (this invention) | 2-Anilino-3-chloro-6-diethylamino-fluoran | 4-Hydroxyphenyl-4'-benzyloxyphenyl-sulfone | β-phenetyl-p-biphenyl ether | 0.07 | 1.10 | 0.07 | 98% | 99% |
| 5 (this invention) | 2-Anilino-3-chloro-6-diethylamino-fluoran | 4-Hydroxyphenyl-4'-p-isopropylbenzyl-oxyphenyl sulfone | β-phenetyl-p-biphenyl ether | 0.08 | 1.08 | 0.07 | 98% | 100% |
| 6 (this invention) | 2-Anilino-3-chloro-6-diethylamino-fluoran | 4-Hydroxyphenyl-4'-(4-p-t-butylphenyl-oxybutyloxy)phenyl sulfone | Stearic acid amide | 0.07 | 0.98 | 0.06 | 95% | 99% |
| Comparative Sample 1 | 2-Anilino-3-chloro-6-diethylamino-fluoran | 2,2-Bis-(4-hydroxy-phenyl)propane | — | 0.05 | 0.35 | 0.12 | 82% | 90% |
| Comparative Sample 2 | 2-Anilino-3-chloro-6-diethylamino-fluoran | 2,2-Bis-(4-hydroxy-phenyl)propane | Stearic acid amide | 0.08 | 0.52 | 0.10 | 56% | 81% |
| Comparative Sample 3 | 2-Anilino-3-chloro-6-diethylamino-fluoran | Bis-4-hydroxy-phenyl)sulfone | — | 0.07 | 0.10 | 0.10 | 50% | 85% |

The above results clearly show that greater color density can be obtained when the electron accepting compounds of the invention are used and that undesirable fog density is not increased. Furthermore, color images produced using heat-sensitive materials of the invention have an improved stability residual ratio and improved fastness to light.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material, comprising:

an electron donating colorless dye; and an electron accepting compound represented by the general formula (I):

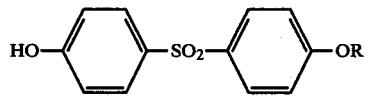

(I)

wherein R is an alkyl group having at least 4 carbon atoms, an aralkyl group, a aryl group, an alkylcarbonyl group, an arylcarbonyl group, an alkylsulfonyl group or an arylsulfonyl group.

2. A heat-sensitive recording material as claimed in claim 1, wherein R is an alkyl group having at least 4 carbon atoms, a halogen substituted alkyl group, an alkoxy substituted alkyl group, an aralkyl group, an alkyl substituted aralkyl group, an alkoxy substituted aralkyl group, an alkylcarbonyl group, or an arylcarbonyl group.

3. A heat-sensitive recording material as claimed claim 2, wherein R is an alkyl group having at least 4 carbon atoms, an aralkyl group, or an alkyl substituted aralkyl group.

4. A heat-sensitive recording material as claimed in claim 3, wherein the alkyl group has 6 to 20 carbon atoms, the aralkyl group has 7 to 20 carbon atoms and the alkyl substituted aralkyl group has 8 to 25 carbon atoms.

* * * * *